United States Patent [19]

Maier

[11] 4,416,207

[45] Nov. 22, 1983

[54] BLIND STITCH SEWING MACHINE

[75] Inventor: Erwin Maier, Koengen, Fed. Rep. of Germany

[73] Assignee: Maier-Unitas GmbH, Koengen, Fed. Rep. of Germany

[21] Appl. No.: 357,557

[22] Filed: Mar. 12, 1982

[30] Foreign Application Priority Data

Apr. 1, 1981 [DE] Fed. Rep. of Germany ..... 3113088

[51] Int. Cl.[3] ..... D05B 1/24; D05B 27/22

[52] U.S. Cl. ..... 112/178; 112/311; 112/315

[58] Field of Search ..... 112/178, 176, 311, 315, 112/314

[56] References Cited

U.S. PATENT DOCUMENTS

| | | | |
|---|---|---|---|
| 2,333,128 | 11/1943 | Stevenson | 112/315 X |
| 2,763,225 | 9/1956 | Mensching | 112/178 |
| 4,114,547 | 9/1978 | Russell | 112/178 |
| 4,312,290 | 1/1982 | Norz | 112/315 X |

FOREIGN PATENT DOCUMENTS

| | | | |
|---|---|---|---|
| 279353 | 10/1963 | Australia | 112/315 |

*Primary Examiner*—H. Hampton Hunter

*Attorney, Agent, or Firm*—Michael J. Striker

[57] ABSTRACT

A blind stitch sewing machine comprises in the transmission between its main drive shaft and the fabric feeder an arrangement for stitch shortening and tacking. This arrangement comprises a coupling device with two arms which are guided for movement in longitudinal direction relative to each other and coupled by a coupling spring. One of the arms, which is fixed to the fabric feeder for movement therewith is provided with a recess into which a solenoid operated bolt is engageable when the fabric feeder reaches its forward end position to thereby stop the one arm and the fabric feeder connected thereto, while the main drive shaft and the remainder of the transmission remain in operation. Thereby feed of the fabric is substantially stopped and the seam tacked. Subsequently thereto the bolt is withdrawn from the recess and the coupling spring will again couple the one arm to the drive.

12 Claims, 7 Drawing Figures

BLIND STITCH SEWING MACHINE

BACKGROUND OF THE INVENTION

The present invention relates to a blind stitch sewing machine with a stitch plate, a needle which swings above the stitch plate and transverse to a plunger arranged beneath the stitch plate, with a fabric feeder which moves along a substantially elliptical path from above through an opening in the stitch plate against at least one pressure foot, and in which the fabric feeder is driven from a main drive shaft over a transmission provided with an arrangement for reducing the stitch length and for stitch tacking, as well as a control device for this arrangement.

It is desirable in such blind stitch sewing machines to sew a plurality of stitches closely adjacent to each other by shortening the stitch length, which in a blind stitch sewing machine is about between 3 and 8 mm to thereby obtain a tacking of the thus-produced blind stitch seam. This is especially desirable in a single chain stitch which can be relatively easily pulled up from the rear.

A blind stitch sewing with such an arrangement for stitch tacking is for instance known from the U.S. Pat. No. 4,114,547 in which the two pressure feet can be tilted by a special adjusting device downwardly away from the stitch plate, so that the fabric feeder lacks a counter pressure for the fabric feed, thereby substantially interrupting the forward movement of the fabric, while the fabric feeder slides on the fabric. This known arrangement for stitch tacking has however essential disadvantages. The tilting away of the pressure feet in downward direction will result in improperly clamping the fabric during the stitch tacking. The fabric can therefore be displaced while the needle penetrates thereinto. This in turn will result in improperly carried-out stitch tacking, or that for instance clearly visible undesired openings in the fabric are produced during the stitch tacking. It is further possible that a heavy fabric may still be transported and no stitch tacking is produced.

Another blind stitch sewing machine of the above-mentioned kind is disclosed in the U.S. Pat. No. 4,312,290. This known blind stitch sewing machine is provided in the transmission for the drive of the fabric feeder with a device for stitch tacking by means of reducing the stitch length, including a control arrangement coordinated with this device, which comprises a plurality of cooperating element acting on the drive of the fabric feeder in such a manner that the latter is moved from its normal elliptical path in upward direction away from the stitch plate, so that the engagement of the fabric feeder with the fabric is either reduced or completely eliminated. The fabric feeder is thereby still driven from the main shaft and is moved accordingly above the stitch plate. This known construction will likewise not produce a sufficient clamping of the fabric during actuation of the device for stitch tacking, to prevent displacement of the fabric when the needle penetrates thereinto. Furthermore the additional mechanical expenditure of this known device is considerable since various additional elements are necessary in order to move the normal drive of the fabric feeder in upward direction. A further disadvantage of this known device is that an exact adjustment of the device to the respective fabric thickness is necessary.

SUMMARY OF THE INVENTION

It is an object of the present invention to provide a blind stitch sewing machine of the above-mentioned kind which avoids the disadvantages of such blind stitch sewing machines known in the art.

It is a further object of the present invention to provide a blind stitch sewing machine of the aforementioned kind in which the arrangement for stitch tacking and the control device coordinated therewith is constructed in a simple, space-saving manner so as to be produceable at reasonable cost while working in a reliable manner, especially to stabilize and properly clamp the fabric in the region of the stitch plate during the stitch tacking, and without the necessity of a special adjustment for thin or heavy fabrics.

With these and other objects in view, which will become apparent as the description proceeds, the blind stitch sewing machine according to the present invention mainly comprises a stitch plate having an opening, a plunger below the stitch plate moveable in a predetermined direction, a needle above the stitch plate swingable in a direction transverse to this predetermined direction, a fabric feeder extending from above through the opening in the stitch plate, means for moving the fabric feeder along a substantially elliptical path between a forward and a rearward end position against at least one pressure foot and including a main drive shaft and transmission means between the main drive shaft and the fabric feeder, and means in the transmission means for stitch shortening and tacking and comprising coupling means normally coupling the drive shaft with the fabric feeder so that the latter is moved along the substantially elliptical path between the forward and the rear end positions during rotation of the drive shaft, and control means moveable between a first position holding the fabric feeder in the forward end position to thereby disengage the coupling means and a second position out of engagement with the fabric feeder to reengage the coupling means.

The coupling means for producing the stitch tacking makes it possible during disengagement of the coupling means to disconnect the fabric feeder and/or also the plunger from the remainder of the drive and to stop the fabric feeder at its forward end position while the remainder of the transmission is driven by the main drive shaft. The arresting of the fabric feeder stops the fabric feed to reduce thereby the length of the stitch practically to zero so that several stitches may be made closely adjacent to each other. The arresting of the fabric feeder in its forward end position will assure that the fabric remains clamped between the fabric feeder and the pressure feet, so that the fabric cannot be displaced during penetration of the needle into the same. The arrangement for stitch tacking is simple in its construction, it can be manufactured at reasonable cost and it is perfect in its function. The arrangement will properly function with heavy or thin fabric without requiring a specific adjustment of the arrangement.

The aforementioned transmission means preferably comprise an eccentric fixed to the drive shaft for rotation therewith, a first arm pivotally connected with one end about the eccentric and a second arm fixed at one end to the fabric feeder for movement therewith and the coupling means is in this case arranged between the arms and comprising end faces of the arms directed toward each other and spring means for yieldably maintaining the end faces in abutting relationship. The spring means preferably comprise a tension coil spring connected at opposite ends to the first and the second arm, respectively. The arrangement includes also guide means for aligning the arms in longitudinal direction, while permitting the arms to move relative to each other in this direction. These guide means preferably comprise at least one guide rod projecting from the other end of one of the arms and at least one guide bore extending from the other end of the other arm into the latter, in which the guide rod is guided. The guide rod has a length so that even if the coupling means is disengaged a portion of the guide rod will still be located in the aforementioned bore.

The aforementioned control means preferably comprise recess means and bolt means, in which one of these two means is fixed to the second arm and the other is moveable to engage with the one of the last-mentioned two means. Preferably the recess means is provided in the second arm and the bolt means is moveable in a direction transverse to the elongation of the latter into and out of the recess means by means of a solenoid.

The overall arrangement is exceedingly simple and can be manufactured at very reasonable cost.

During the production of blind stitch seams as single chain stitches, the consumption of thread is evidently greater than during the time the stitches are shortened for producing the stitch tacking. Therefore the blind stitch sewing machine according to the present invention includes preferably also an additional thread tensioner, known per se, which is actuated together with the arresting of the arm connected to the fabric feeder so that during reduction of the stitch length and the concomitant reduced consumption of thread the thus-produced stitches are properly tensioned.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

The overall construction of blind stitch sewing machines is well known in the art, as for instance disclosed in the above-mentioned U.S. Pat. No. 4,312,290 and the U.S. Pat. No. 4,114,547, so that it is believed to be unnecessary to illustrate and describe the overall construction of such a blind stitch sewing machine and to refer in this respect to the known state of the art. Generally, a blind stitch sewing machine has a housing with a supporting surface for the material, for instance in the form of a tilting table and an upper bent arm, in which a main drive shaft 10 for the drive of the various elements of the machine is arranged, provided at one end with a non-illustrated pulley and a hand wheel for adjusting the position of the drive shaft 10. In addition, a synchronizing circuit for control of the various functions of the sewing machine may be provided, which is likewise not shown. The upper arm carries at a front portion thereof a stationary, schematically-illustrated stitch plate 11. A lower arm arranged in the region of the material support surface, which may for instance be downwardly tiltable against the force of a spring, carries two likewise not-illustrated pressure feet and a plunger 9, indicated in dotted lines, which for instance may likewise be driven from the main shaft 10. The main shaft 10 serves further in a known manner to drive a bent needle 8 as well as a non-illustrated gripper. The needle and the gripper are arranged above the stitch plate 11. The needle 8 and the gripper are driven in a direction transverse to the direction of movement of the plunger 9, which is arranged below the stitch plate 11.

Figures 1, 2, 3, 4, 5:
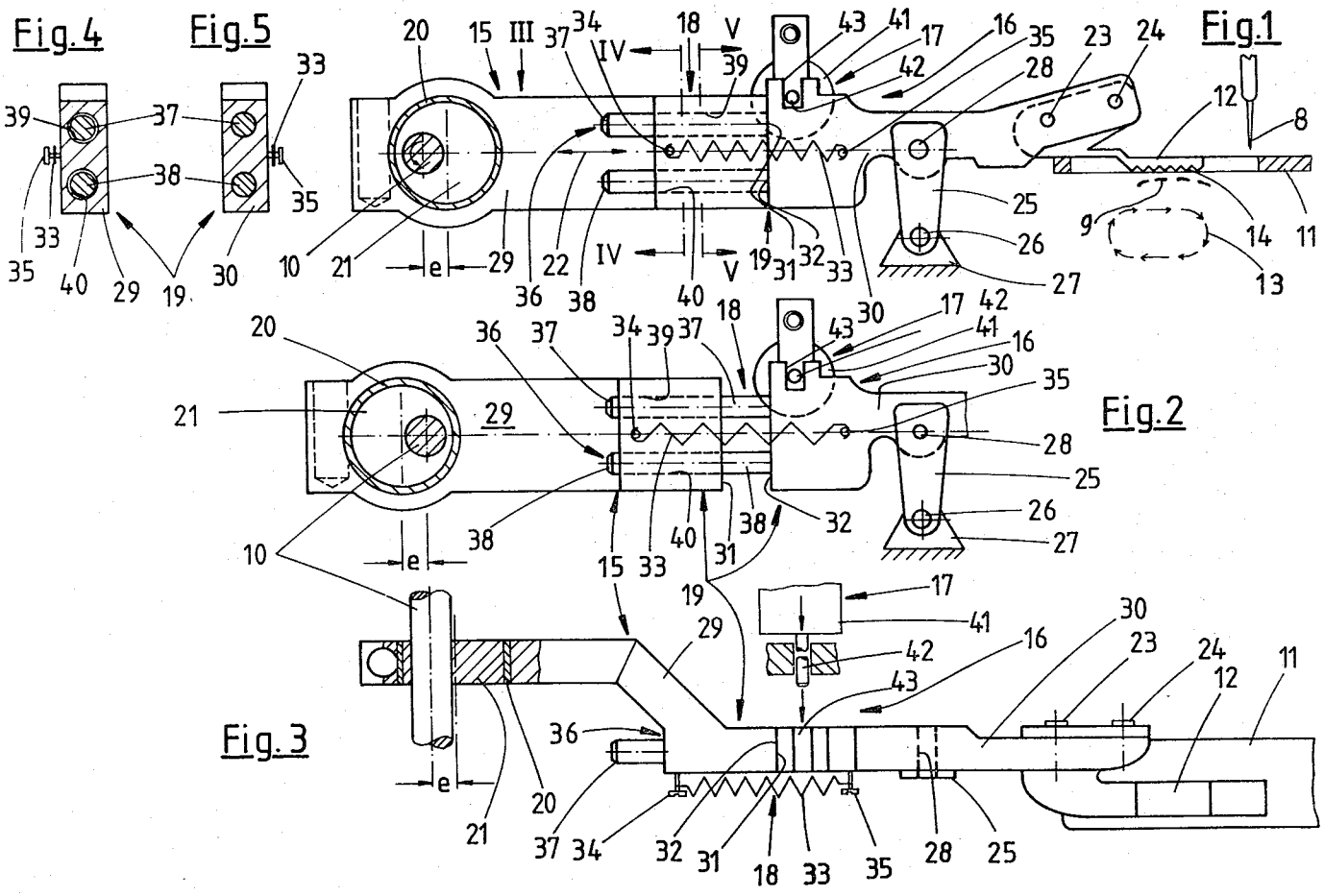
FIG. 1 is a schematic, partly sectioned side view of part of a blind stitch sewing machine according to the present invention and illustrating the transmission for the drive of a fabric feeder with a coupling arrangement, whereby this coupling arrangement is shown in the coupled position in FIG. 1 and the fabric feeder in its forward end position.
FIG. 2 is a schematic side view corresponding to FIG. 1, but showing the coupling disengaged.
FIG. 3 is a schematic partly sectioned top view of the arrangement shown in FIG. 1.
FIGS. 4 and 5 are respectively schematic cross sections taken along the line IV—IV, respectively V—V of FIG. 1.

The blind stitch sewing machine according to the present invention includes further a fabric feeder 12, which is driven in such a manner that it moves along a substantially elliptical path, indicated in dotted lines in FIG. 1 at 13, from above through the opening in the stitch plate 11 and against the lower non-illustrated pressure feet. The fabric feeder 12 is provided on its bottom face with teeth 14 which are adapted to penetrate from above into the material, not shown in FIG. 1, to move the latter from the right to the left, as viewed in FIG. 1, during passage of the fabric feeder 12 along the elliptical path 13.

The fabric feeder 12 is driven from the main drive shaft 10 over transmission means generally designated with the reference numeral 15. A device 16 for stitch tacking by reducing the stitch length is arranged in the transmission means 15. The device 16 is controlled by schematically-indicated control means 17.

The device 16 for stitch tacking is provided in the transmission between the main drive shaft 10 and the fabric feeder 12 with a coupling device 18 which is shown in FIGS. 1 and 3 in engaged and in FIG. 2 in disengaged position.

The coupling device 18 is operable by the control device 17 to thereby separate the fabric feeder 12 from the remainder of the drive by arresting the fabric feeder 12, preferably in its forward end position, as shown in FIG. 1, or at least closely adjacent to this forward end position.

At the disengaged position of the coupling device 18, the fabric feeder 12 remains at standstill at a position which it assumed during disengagement of the coupling device 18. This position of the fabric feeder 12 is preferably its forwardmost position or at least closely adjacent to this forwardmost position in the stitch plate 11. The remainder of the transmission driven by the main drive shaft 10 executes at the disengaged coupling device 18 the same movement as before. When the fabric feeder 12 is arrested during disengagement of the coupling device 18, the fabric feed is evidently stopped.

Thereby, the length of the stitch is reduced to zero so that a plurality of stitches may be executed closely adjacent to each other to produce the stitch tacking.

The transmission 15 to drive the fabric feeder 12 includes arm means 19, the left end of which, as viewed in the drawing, is turnably mounted on a bearing 20, preferably formed from sintered powder metal, on an eccentric 21 which is in turn mounted with the eccentricity "e" on the main drive shaft 10 for rotation therewith. This rotation of the eccentric 21 causes reciprocation of the arm means 19 in the direction of the arrow 22 with a small superimposed tilting movement.

The fabric feeder 12 is exchangeably connected at 23 and 24 to the right end, as viewed in FIG. 1, of the arm means 19. A swing arm 25 is pivotally connected at its upper end at 28 to the region of the arm means 19 rearwardly of the connections 23 and 24, whereas the lower end of the swing arm 25 is pivotally connected at 26 to a stationary part 27 of the machine housing.

To form the coupling device 18, the arm means 19 is divided in two separate arms 29 and 30, of which the arm 29 is connected to the eccentric 21, whereas the arm 30 carries the fabric feeder 12.

The coupling means are thereby constituted by end faces 31 and 32 of the two arms 29 and 30, which abut in the engaged position of the coupling means against each other, as best shown in FIG. 1, whereas in the disengaged position of the coupling means, as shown in FIG. 2, these end faces 31 and 32 are separated from each other. The coupling means 18 comprise further spring means 33, which normally bias the aforementioned end faces 31 and 32 into abutting relationship. The spring means 33 are preferably constituted by a coiled tension spring which is connected at one end by screw 34 to the arm 29 and at the other end by a screw 35 to the arm 30. The couple spring 33 will assure in the engaged position of the coupling means 18 abutment of the end face 31 and 32 against each other to connect thereby the arms 29 and 30 for simultaneous movement. In the disengaged position of the coupling means 18, as shown in FIG. 2, and arresting of the fabric feeder 12, the coupling spring 33 will elastically balance the relative movement of the still-driven arm 29.

The coupling means 18 comprises further guide means 36 for maintaining the arms 29 and 30 in alignment in the engaged, as well as in the disengaged position of the coupling means. The guide means 36 preferably comprise two superimposed parallel guide rods 37, 38 press-fitted in bores provided in one of the arms and guided with a slide fit in corresponding bores 39, 40 in the other arm.

The control device 17 acts on the arm 30 to which the fabric feeder 12 is connected. The control device 17 is thereby operated by a commercially produced so-called stop-motor in such a manner that when the fabric feeder 12 reaches its forwardmost position, as shown in FIG. 1, the control device 17 blocks the arms 30 and arrests the same. During the further drive of the transmission from the main drive shaft 10, that is during start of the return stroke, the other arm 29 is moved towards and left and thereby separated from the arm 30. During this movement the arms 29 and 30 remain aligned in longitudinal direction by means of the guide means 36. The fabric feeder 12 arrested in its forward end position thus retains the fabric while the stitch tacking is produced with a substantially zero stitch length.

After the necessary number of stitches for the stitch tacking is produced, the control device 17 is operated by the stop-motor to again release the arm 30 so that the coupling spring 33 will hold the end faces 31 and 32 of the two arms again in abutting relationship. If then the main drive shaft 10 is turned until the needle is moved out of the fabric, the thread may be severed in a known manner by a thread cutting of known construction, not illustrated in the drawing.

The control device 17 according to the present invention may be constructed in various different ways. By way of an example a construction of the control device 17 is shown in the drawing in which a locking bolt 42 is moved by an electromagnetic solenoid 41 in a direction transverse to the arm means 19 into and out of a recess 43 provided at the upper surface of the arm 30.

Figure 6:
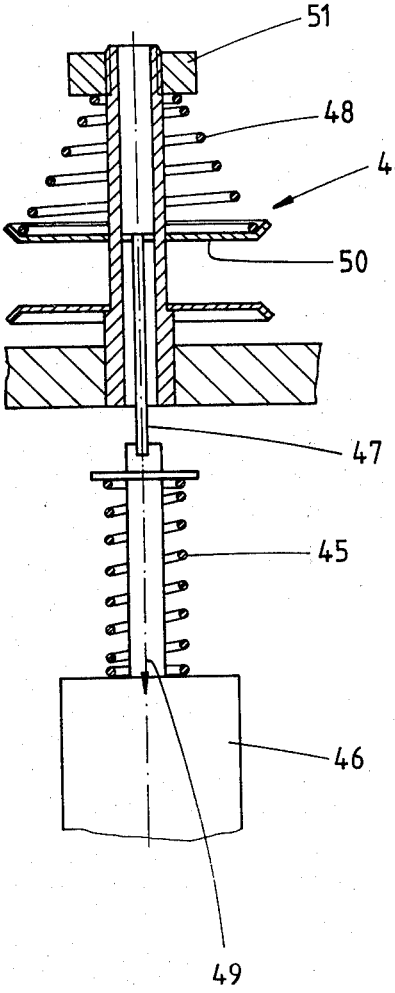
FIG. 6 is a schematic partly sectioned side view of an additional thread tensioner to be actuated during the stitch shortening.
Figure 7:
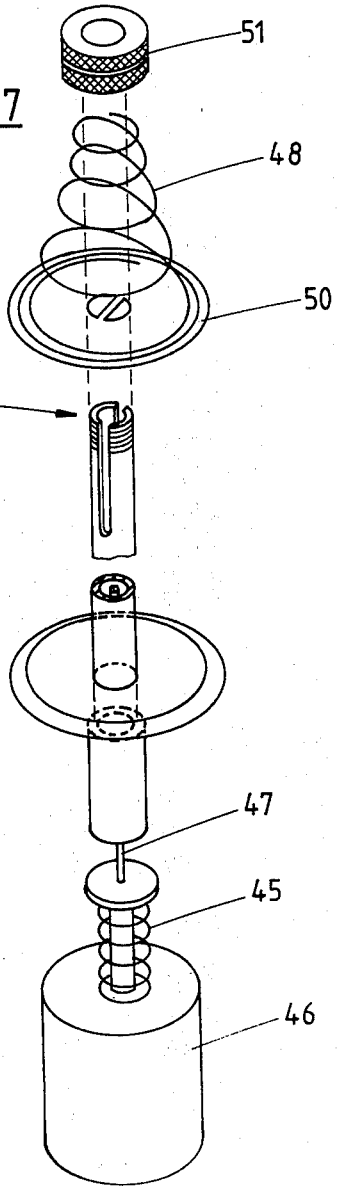
FIG. 7 is a perspective exploded view of the thread tensioner shown in FIG. 6.

The blind stitch sewing machine according to the present invention is preferably also provided with a further thread tensioner 44 of known construction, in addition to the normally provided thread tensioner. The thread tensioner 44 serves during the stitch tacking, that is when the coupling means 18 is disconnected, to reduce at each tacking stitch the necessary amount of thread in such a manner that, despite the now lesser required thread due to the reduced stitch length, the produced stitches are properly tensioned. This means therefore that the additional thread tensioner 44 is actuated at each tacking stitch to thereby increase the thread tensioning as compared to the normal thread tensioning. Basically, any known thread tensioner is suitable for this purpose, which may be moved from an inactive to an active position to increase in the latter the thread tension. In the embodiment illustrated in FIGS. 6 and 7, the thread tensioner 44 is shown in FIG. 6 in its inactive position, in which the upper clamping plate 50 is held in an upper position by the coiled compression spring 45 arranged about the armature of the electromagnet 46 and the pin 47 against the force of an adjustable compression spring 48 acting on the upper surface of the clamping plate 50. The force of the compression spring 48 may be adjusted by the nut 51. If the magnet 46 is energized, the pin 47 is moved downwardly in the direction of the arrow 49 under simultaneous compression of the spring 45, whereby the upper clamping plate 50 is moved with a predetermined force produced by the spring 48, against the lower clamping plate so that a thread between the two clamping plates is clamped with a certain force. The magnet 46 is energized together with the control device 17 and disengaging the coupling device 18.

It will be understood that each of the elements described above, or two or more together, may also find a useful application in other types of blind stitch sewing machines, differing from the types described above.

While the invention has been illustrated and described as embodied in a blind stitch sewing machine with an arrangement for stitch shortening and tacking, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A blind stitch sewing machine comprising a stitch plate having an opening; a plunger below said stitch plate moveable in a predetermined direction; a needle above the stitch plate swingable in a direction transverse to said predetermined direction; a fabric feeder extending from above through said opening in said stitch plate; means for moving said fabric feeder along a substantially elliptical path between a forward and a rearward end position against at least one pressure foot and including a main drive shaft and transmission means between said main drive shaft and said fabric feeder; means in said transmission means for stitch shortening and tacking and comprising coupling means normally coupling said drive shaft to said fabric feeder so that the latter is moved along said substantially elliptical path between said forward and said rearward end positions during rotation of said drive shaft; and control means moveable between a first position holding said fabric feeder in said forward end position to thereby disengage said coupling means and a second position out of engagement with said fabric feeder to reengage said coupling means.

2. A blind stitch sewing machine as defined in claim 1, wherein said transmission means comprises an eccentric fixed to said drive shaft for rotation therewith, said coupling means being arranged between said eccentric and said fabric feeder.

3. A blind stitch sewing machine as defined in claim 2, wherein said transmission means further includes a first arm pivotally connected at one end about said eccentric and a second arm fixed at one end to said fabric feeder for movement therewith, said coupling means being arranged between said arms.

4. A blind stitch sewing machine as defined in claim 3, wherein said coupling means comprises end faces of said arms directed toward each other and spring means for yieldably maintaining said end faces in abutting relationship.

5. A blind stitch sewing machine as defined in claim 4, wherein said spring means comprises a tension spring connected at opposite ends to said first and said second arm, respectively.

6. A blind stitch sewing machine as defined in claim 4, and including guide means for aligning said arms in longitudinal direction while permitting said arms to move relative to each other in said direction.

7. A blind stitch sewing machine as defined in claim 6, wherein said guide means comprises at least one guide rod projecting from the other end of one of said arms and at least one guide bore extending from the other end of the other arm into the latter in which said guide rod is guided, said guide rod having a length so that even if said coupling means is disengaged a portion of said guide rod will still be located in said bore.

8. A blind stitch sewing machine as defined in claim 3, wherein said control means comprises recess means and bolt means, one of said last-mentioned two means being fixed to said second arm and the other of said last-mentioned two means being moveable to engage with said one of said last-mentioned two means.

9. A blind stitch sewing machine as defined in claim 8, wherein said recess means is fixed to said second arm and wherein said bolt means is moveable in a direction transverse to the elongation of said second arm.

10. A blind stitch sewing machine as defined in claim 9, wherein said recess means is constituted by a notch formed at the upper surface of said second arm.

11. A blind stitch sewing machine as defined in claim 9, and including electromagnet means for moving said bolt means into and out of said recess means.

12. A blind stitch sewing machine as defined in claim 3, and including a swing arm pivotally connected at one end to a region of said second arm intermediate opposite ends of the latter and pivotally connected at the other end to a fixed point of the machine.

* * * * *